US005911273A

United States Patent [19]

Brenner et al.

[11] Patent Number: 5,911,273

[45] Date of Patent: Jun. 15, 1999

[54] HEAT TRANSFER DEVICE OF A STACKED PLATE CONSTRUCTION

[75] Inventors: Martin Brenner, Kieselbronn; Conrad Pfender, Besigheim; Walter Wolf, Oppenweiler-Zell, all of Germany

[73] Assignee: Behr GmbH & Co., Stuttgart, Germany

[21] Appl. No.: 08/933,084

[22] Filed: Sep. 18, 1997

Related U.S. Application Data

[63] Continuation-in-part of application No. 08/691,897, Aug. 1, 1996, Pat. No. 5,718,286.

[30] Foreign Application Priority Data

| | | | |
|---|---|---|---|
| Aug. 1, 1995 | [DE] | Germany | 195 28 117 |
| Sep. 24, 1996 | [DE] | Germany | 196 39 114 |

[51] Int. Cl.[6] ..... F28F 3/08

[52] U.S. Cl. ..... 165/167; 165/166; 165/DIG. 363

[58] Field of Search ..... 165/167, 166, 165/DIG. 363, 165, 164

[56] References Cited

U.S. PATENT DOCUMENTS

| | | | |
|---|---|---|---|
| 3,017,161 | 1/1962 | Slaasted . | |
| 4,291,754 | 9/1981 | Morse et al. | 165/167 X |
| 4,516,632 | 5/1985 | Swift et al. | 165/167 |
| 4,572,766 | 2/1986 | Dimitriou | 165/167 X |
| 4,744,414 | 5/1988 | Schon . | |
| 4,815,534 | 3/1989 | Fuerschbach . | |
| 4,880,055 | 11/1989 | Niggemann et al. | 165/167 |
| 4,893,673 | 1/1990 | Rosman et al. | 165/167 |
| 5,016,707 | 5/1991 | Nguyen | 165/167 |
| 5,025,856 | 6/1991 | VanDyke et al. | 165/167 |
| 5,099,915 | 3/1992 | VanDyke | 165/167 X |
| 5,212,004 | 5/1993 | Böttcher et al. | 165/167 X |
| 5,392,849 | 2/1995 | Matsunaga et al. | 165/167 |
| 5,429,183 | 7/1995 | Hisamori et al. . | |
| 5,657,818 | 8/1997 | Böttcher et al. | 165/167 |

FOREIGN PATENT DOCUMENTS

| | | | |
|---|---|---|---|
| 0 503 080 | 9/1992 | European Pat. Off. . | |
| 929698 | 1/1948 | France . | |
| 2412805 | 7/1979 | France . | |
| 2 583 864 | 12/1986 | France . | |
| 540918 | 12/1931 | Germany . | |
| 37 09 278 | 3/1989 | Germany . | |
| 32 06 397 | 10/1994 | Germany . | |
| 62-213688 | 9/1987 | Japan | 165/167 |
| 3-7885 | 1/1991 | Japan | 165/167 |
| 629385 | 9/1949 | United Kingdom . | |
| 732637 | 6/1955 | United Kingdom | 165/167 |
| 2 019 550 | 10/1979 | United Kingdom . | |

*Primary Examiner*—Ira S. Lazarus
*Assistant Examiner*—Christopher Atkinson
*Attorney, Agent, or Firm*—Evenson, McKeown, Edwards & Lenahan, P.L.L.C.

[57] ABSTRACT

Heat transfer device of a stacked plate construction has a stacked plate construction consisting of alternately stacked flow duct plate units with flow duct openings and connection duct openings as well as connection cover plate units with connection duct openings provided such that two separate fluid flow systems are formed. The equal-sided connection duct openings overlap only by means of an interior portion with the equal-sided ends of the flow duct openings, whereas, by means of an exterior portion, while forming a respective connection conduit, they extend in the area outside the flow duct openings. This implements a compact plate stack construction with an optimal connection geometry for very low pressure losses.

7 Claims, 3 Drawing Sheets

HEAT TRANSFER DEVICE OF A STACKED PLATE CONSTRUCTION

The present application is a continuation-in-part of application Ser. No. 08/691,897, filed Aug. 1, 1996 now U.S. Pat. No. 5,718,286, which is based on German application 195 28 117.9 filed Aug. 1, 1995. The content of that parent application is used as the basis of the present application and is therefore fully incorporated here by reference in order to avoid unnecessary repetitions.

This application claims the priority of German application 196 39 114.8 filed in Germany on Sep. 24, 1996, the disclosure of which is expressly incorporated by reference herein.

BACKGROUND AND SUMMARY OF THE INVENTION

The invention relates to a heat transfer device of a stacked plate construction consisting of several plates which are stacked above one another and provided with openings.

In the parent application, heat transfer devices of the initially mentioned type are described comprising: flow duct plate units with one or several side-by-side flow duct openings, which extend between two plate side areas, as well as with connection duct openings, which are arranged separately of the connection duct openings, and connection cover plate units which have connection duct openings which are arranged at least in two plate side areas, wherein the flow duct plate units and the connection cover plate units are alternately stacked on one another such that no fluidic connection exists between the flow duct opening of adjacent flow duct plate units; and such that the equal-sided ends of the flow duct openings of a respective flow duct plate unit are in a fluidic connection with one another by way of an overlapping connection duct opening of an adjacent connection cover plate unit and are in a fluidic connection with the equal-sided ends of the flow duct openings of in each case a next but one flow duct plate unit, by way of overlapping connection duct openings of adjoining plate units, These heat transfer devices of a stacked plate construction can be manufactured at comparatively low expenditures and are suitable for the separate flowing-through of at least two heat transfer fluids, in which case largely laminar flow conditions and a satisfactory heat transfer capacity are ensured.

In the embodiments explicitly illustrated and described in the parent application, the plate units of a respective heat transfer device plate stack are all of a rectangular shape. The connection duct openings extend in the form of oblong holes along the respective rectangle sides. A row of flow duct openings of a respective flow duct plate unit, which are situated in parallel side-by-side, on the end side, essentially overlaps with the whole passage cross-section of the equal-sided connection duct opening of an adjacent connection cover plate unit, the overlapping cross-section determining the opening cross section of the resulting distributor duct or collecting duct on the corresponding plate stack side. In this case, separating webs, which laterally mutually space the flow duct openings of a respective flow duct plate unit situated in parallel side-by-side, extend with their end areas transversely through the distributor duct or collecting duct.

The invention is based on the technical problem of providing a heat transfer device of a stacked plate construction of the general type described in the parent application which has particularly good fluid flow characteristics with low pressure losses and nevertheless can be implemented in a relatively compact construction.

The invention solves this problem by providing a heat transfer device of the above-mentioned type wherein one connection duct opening respectively is provided on each plate side area of the flow duct plate units as well as of the connection cover plate units, the respective equal-sided, mutually overlapping connection duct openings, by means of an exterior portion, forming a connection conduit situated outside the area of the flow duct openings, from which connection conduit, with the exception of the ones which are arranged adjacent to the ends of the flow duct openings in the respective flow duct plate units, they extend with one interior portion overlapping into the area of the equal-sided ends of the flow duct openings. In addition to the characteristics explicitly indicated in the parent application, it is specifically provided in the case of this heat transfer device that one connection duct opening respectively is provided on each plate side area of the connection cover plate units as well as of the flow duct plate units, in which case the overlapping connection duct openings of a respective plate stack side form a connection conduit situated outside the area of the flow duct openings, from which connection conduit the connection duct openings, with the exception of those which are arranged adjacent to the ends of the flow duct openings in the respective flow duct plate units, extend with their interior portion into the area of the equal-sided ends of the flow duct openings.

This means that, in contrast to the embodiments according to the parent application, the total passage cross-section of a respective distributor duct or collecting duct is not limited to the overlapping cross-section of the connection duct openings with the flow duct openings but, in addition, comprises the passage cross-section of the pertaining connection conduit which in comparison is preferably clearly larger. By the corresponding selection of the respective connection conduit passage cross-section, in the case of a given plate thickness and plate number in the plate stack for the resulting total passage cross-section of the flow duct openings which are in each case in a fluidic connection with one another, a correspondingly matching passage cross-section of the pertaining distributor duct or collecting duct can be adjusted. In addition, by means of this connection conduit formation, favorable fluid flow characteristics for the distributor ducts and collecting ducts as well as for their flowing into the flow duct openings and for the flowing out of the latter is achieved. On the whole, a compactly constructed heat transfer device of a stacked plate construction can therefore be implemented with laminar flow conditions, low velocity gradients in the flow direction and low deflection and impact pressure losses.

According to especially preferred embodiments of the invention, the heat transfer device is dimensioned such that the passage cross-section of a respective distributor duct or collecting duct formed by mutually overlapping, equal-sided connection duct openings is at least as large as the total passage cross-section of all flow duct openings which are in a fluidic connection with it. This contributes to avoiding undesirably high pressure losses.

Especially preferred embodiments of the heat transfer device are further developed to have a special optimized plate stack geometry which, on the one hand, has favorable flow and heat transfer characteristics and, on the other hand, is relatively easy to manufacture. In a further development of this heat transfer device, the plate stack is closed off on one face by a cover plate while, on the opposite face, a connection plate is provided which has connection openings to the two distributor ducts and collecting ducts respectively. In this manner, the two fluids flowing through the heat transfer device can be supplied and discharged on one plate face end in the direction of the longitudinal axis of the stack.

Other objects, advantages and novel features of the present invention will become apparent from the following detailed description of the invention when considered in conjunction with the accompanying drawings.

DETAILED DESCRIPTION OF THE DRAWINGS

Figure 1:
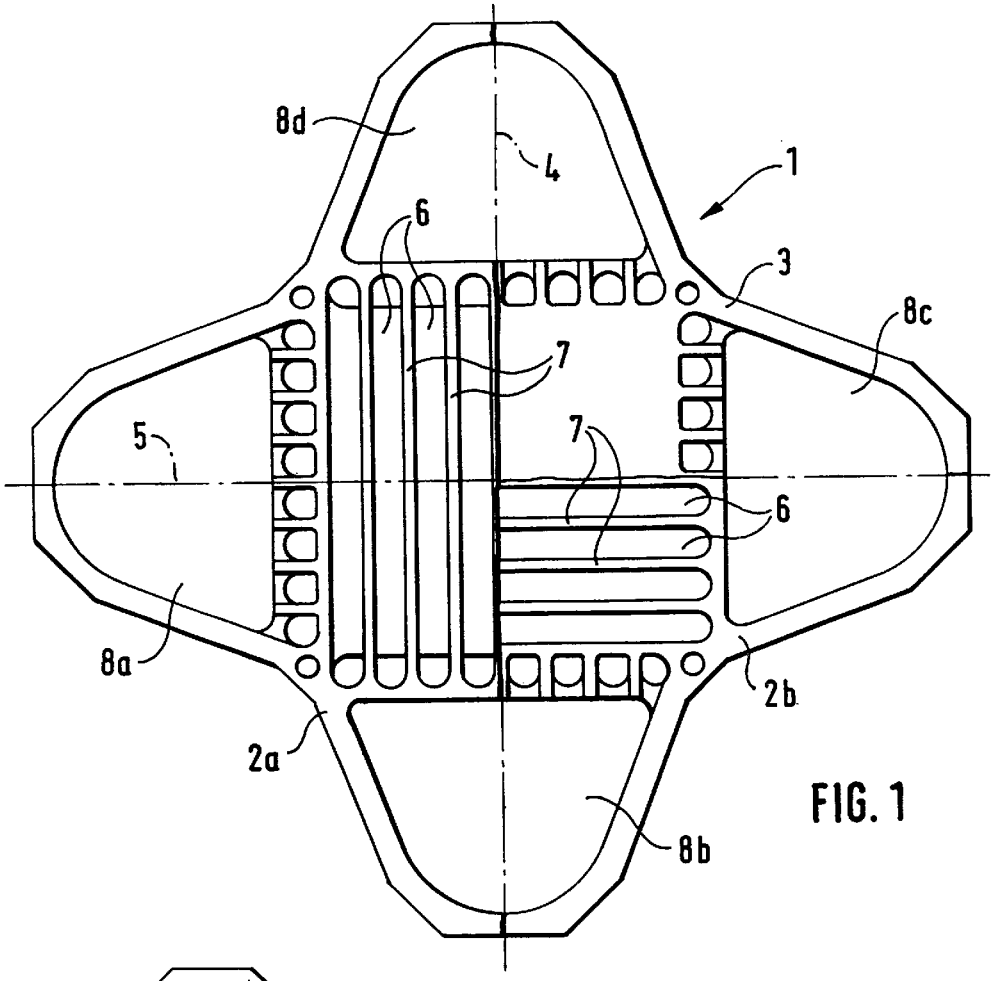
FIG. 1 is a top view of a plate stack of a heat transfer device with partial sectional views in different plate planes, constructed according to a preferred embodiment of the present invention.

FIG. 1 is a top view of a heat transfer device plate stack 1 which shows the latter in each case partially in three different planes in order to illustrate its flow characteristics. The left half of FIG. 1 shows the stack 1 in a plane with a flow duct plate 2*a* situated on top whose right half is cut away in FIG. 1, whereby in the upper right quadrant, one fourth of the connection cover plate 3 situated below is visible whose other fourths are designed mirror-symmetrically with respect to the two transverse axes 4, 5 of the stack. By cutting away the lower quadrant of this connection cover plate 3, which is on the right in FIG. 1, another flow duct plate 2*b* becomes visible which is situated under this connection cover plate 3. Both flow duct plates 2*a*, 2*b* are manufactured as identical components and, in a square center area, contain a row of parallel, linear flow duct openings 6 which are laterally separated from one another by way of narrow separating webs 7. The flow duct plates 2*a*, 2*b*, which are separated from one another by the intermediate connection cover plate 3, are arranged in the plate stack 1 offset with respect to one another by 90° so that the flow ducts 6 of the one flow duct plate 2*a* extend perpendicularly to that of the other flow duct plate 2*b* and are separated from these by the covering center area 3*a* of the connection cover plate 3.

The plate stack 1 consists of an arbitrary desired number of individual plates stacked in this manner, in which case one flow duct plate respectively alternates with a connection cover plate and successive flow duct plates are arranged with mutually perpendicular flow duct openings 6. This implements a cross-flow heat transfer device in the case of which two fluids between which heat is to be transferred are guided through the plate stack 1 in the cross-flow, as described in detail in the parent application with respect to the embodiment of FIG. 1 to 3 of that application, which embodiment corresponds to this extent to the present heat transfer device.

All plates of the plate stack 1 consist of sheet metal plates according to one of the types described in the parent application and have a conformal exterior design. In this case, they have four exterior areas, each of which curving from a pertaining side of the center area in a semicircular manner toward the outside. These exterior areas form hollow shapes and thus define connection duct openings which overlap on the respective plate stack side while forming one semicylindrical connection conduit 8*a*, 8*b*, 8*c*, 8*d* respectively which extends in the longitudinal direction of the stack. The connection conduits 8*a* to 8*d* are situated outside the area of the flow duct openings 6; and two mutually opposite connection conduits 8*a*, 8*c* and 8*b*, 8*d* respectively together with the mouth areas along the respective side of the center area of the stack form a distributor duct and a collecting duct, by way of which the respective fluid is supplied in parallel to the flow duct openings 6 in a fluidic connection therewith and is discharged again on the opposite side.

Figure 2:
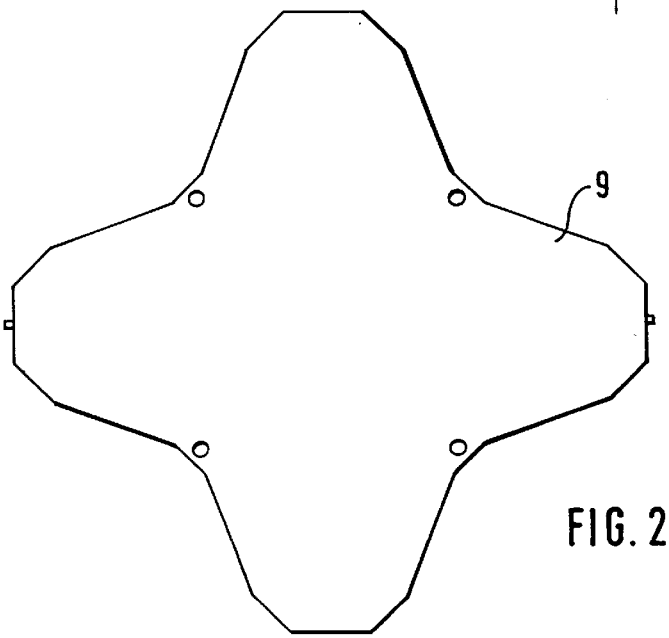
FIG. 2 is a top view of a cover plate used for the plate stack of FIG. 1.
Figure 3:
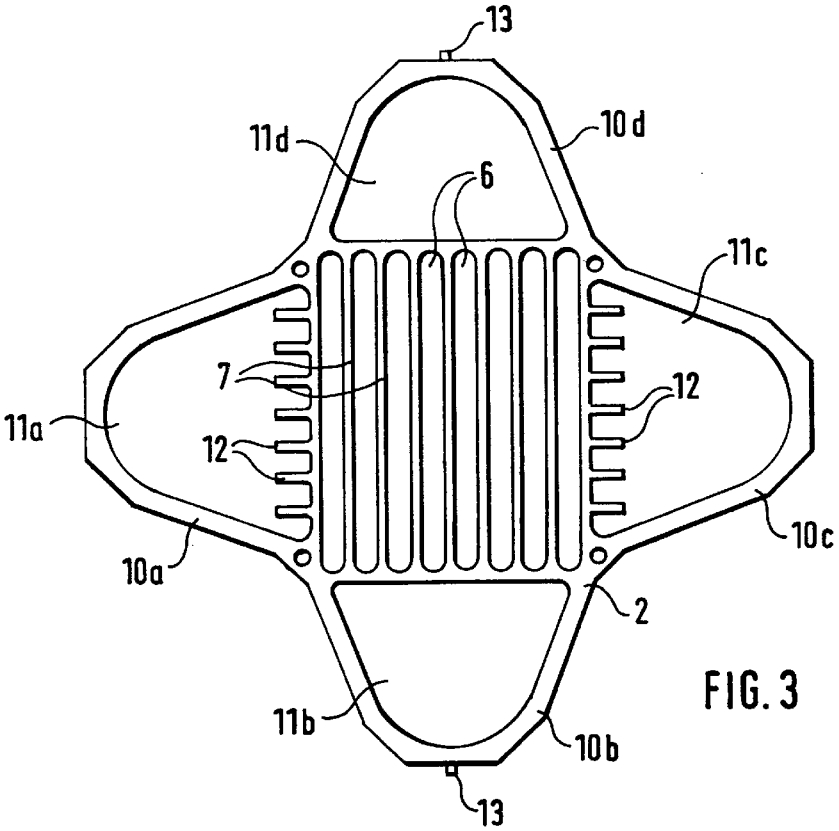
FIG. 3 is a top view of one of the flow duct plates used for the plate stack of FIG. 1.

The flow guidance for the two fluids guided through in the cross flow can be understood best on the basis of the explanation of the construction of the plate stack 1 indicated in the following by means of FIGS. 2 to 5, which individually illustrate the different plates used for this purpose. The plate stack construction starts, for example, with a cover plate 9 which is illustrated in FIG. 2 and which has no openings for the flowing-through of fluid and closes off the plate stack 1 on the face. This cover plate 9 is adjoined by a first flow duct plate 2, as illustrated in FIG. 3. As illustrated above, the flow duct plate 2 has a square center area with a row of linear flow duct openings 6 which are situated in a row in parallel side-by-side and which are laterally spaced from one another by the narrow separating webs 7. The four sides of the center area are adjoined by four exterior areas 10*a* to 10*d* of the flow duct plates which are curved toward the outside in a semicircular manner and which each define a connection duct opening 11*a* to 11*d*. In this case, those two mutually opposite exterior areas 10*b*, 10*d* which are adjacent to the ends of the flow duct openings 6 end with their interior-side boundary in a straight line at a narrow distance from these ends of the flow duct openings 6. In contrast, the two other mutually opposite exterior areas along their interior-side boundary have a comb-type structure of individual comb-type webs 12. On the exterior sides of he exterior areas 10*b*, 10*d* situated opposite one another in the longitudinal direction of the flow duct openings 6, marking cams 13 are mounted which, from the outside, indicate the flow direction of each flow duct plate 2 in the finished plate stack 1.

Figure 4:
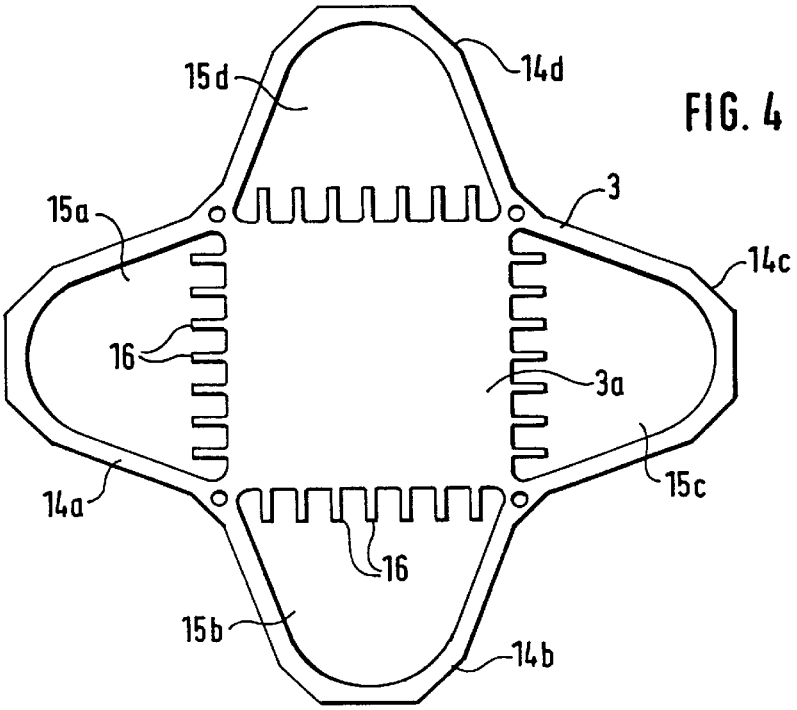
FIG. 4 is a top view of one of the connection cover plates used for the plate stack of FIG. 1.

In the stack, the flow duct plate 2 is then followed by the connection cover plate 3 illustrated in FIG. 4 which has a covering center area 3*a* which has no opening as well as four exterior areas 14*a* to 14*d* of the connection cover plates which extend analogously to the exterior areas 10*a* to 10*d* of the flow duct plates from each side of the center area 3*a* in a semicircular manner as a closed hollow shape toward the outside and as a result enclose a respective connection duct opening 15*a* to 15*d*. In this case, all four exterior areas 14*a* to 14*d* along their interior side adjoining the center area 3*a*, have the comb-type structure with several comb webs 16. When the connection cover plate 3 of FIG. 4 is placed on the flow duct plate 2 of FIG. 3, on the one hand, the two comb web structures 12 of the latter come to rest in an aligned manner against the equal-sided comb web structures 16 of the connection cover plate 3; and, on the other hand, the two other comb web structures 16 of the connection cover plate 3 come to rest in an aligned manner on the end areas of the separating webs 7 of the flow duct plate 2. Correspondingly, the two pertaining connection duct openings 15*b*, 15*d* of the connection cover plate 3 by means of their interior portion defined by the comb web structure 16 overlap with the equal-sided ends of the flow duct openings 6 of the flow duct plate situated underneath.

In this manner, the flow duct openings 6 of a respective flow duct plate on the end side are in a fluidic connection with the equal-sided connection duct openings of the adjacent connection duct plates, as also illustrated in FIG. 1. It is shown that the overlapping cross-section is clearly less than the passage cross-section of the remaining portion of the connection duct openings which forms the exterior connection conduits 8*a* to 8*d*. In this case, the two connection duct openings 11*b*, 11*d* of the flow duct plates which are adjacent to the ends of the flow duct openings 6 have a passage cross-section which because of the absent comb web structure is smaller than that of the other connection duct openings 11*a*, 11*c*, 15*a* to 15*d*.

In the plate stack 1, the connection cover plate 3 of FIG. 4 is then followed again by a flow duct plate 2 according to FIG. 3 which, however, with respect to the flow duct plate situated on the other side of the connection cover plate 3 is mounted to be rotated by 90°; that is, whose flow duct openings 6 extend perpendicularly to those of the flow duct plate on the other side of the connection cover plate 3. This corresponds to the plate sequence shown in FIG. 1 of the first flow duct plate 2*a*, the connection cover plate 3 and the second flow duct plate 2*b* with flow duct openings 6 extending perpendicularly to those of the first flow duct plate. Then a connection cover plate 3 follows again in the stack 1; then again a flow duct plate 2 in a position rotated by 90° with respect to the preceding flow duct plate, etc., until the desired number of plates has been reached. In this manner, the flow duct openings 6 of one set respectively of the next but one flow duct plates 2 are in a fluidic connection with one another by way of a distributor duct and a collecting duct. The last flow duct plate 2 in the plate stack 1 may optionally be one with a position which is identical with the first or one which is rotated by 90° thereto.

Figure 5:
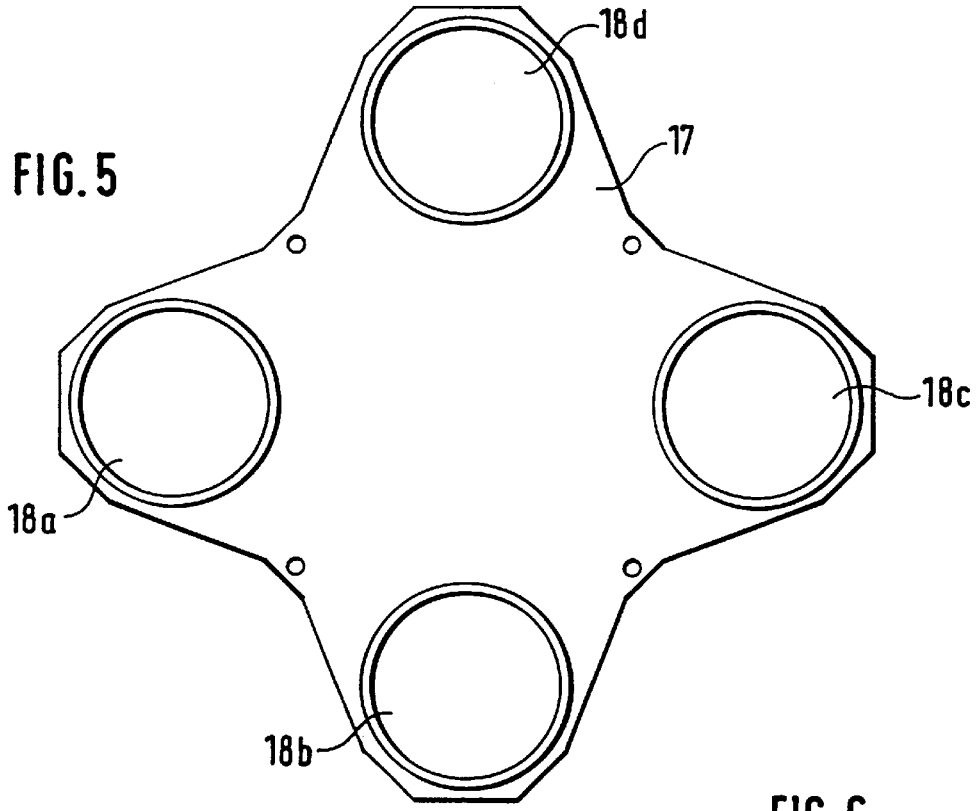
FIG. 5 is a top view of a two-part connection plate unit used for the plate stack of FIG. 1.

Then the plate stack is closed off on its face situated opposite the cover plate 9 by means of a two-part connection plate unit 17 illustrated in FIG. 5. It consists of a lower plate which has four connection openings 18*a* to 18*d* and on which the pertaining connection tubes are disposed, as well as of an upper plate provided with corresponding openings which plate is used for positioning the connection tubes. The connection openings 18*a* to 18*d* overlap in each case with the pertaining connection conduit 8*a* to 8*d* of the plate stack 1 and have a passage cross-section which is comparable to that stack. The connection conduit cross-section therefore determines the passage cross-section of the corresponding distributor duct and collecting duct which remains essentially the same along the longitudinal direction of the stack.

Figure 6:
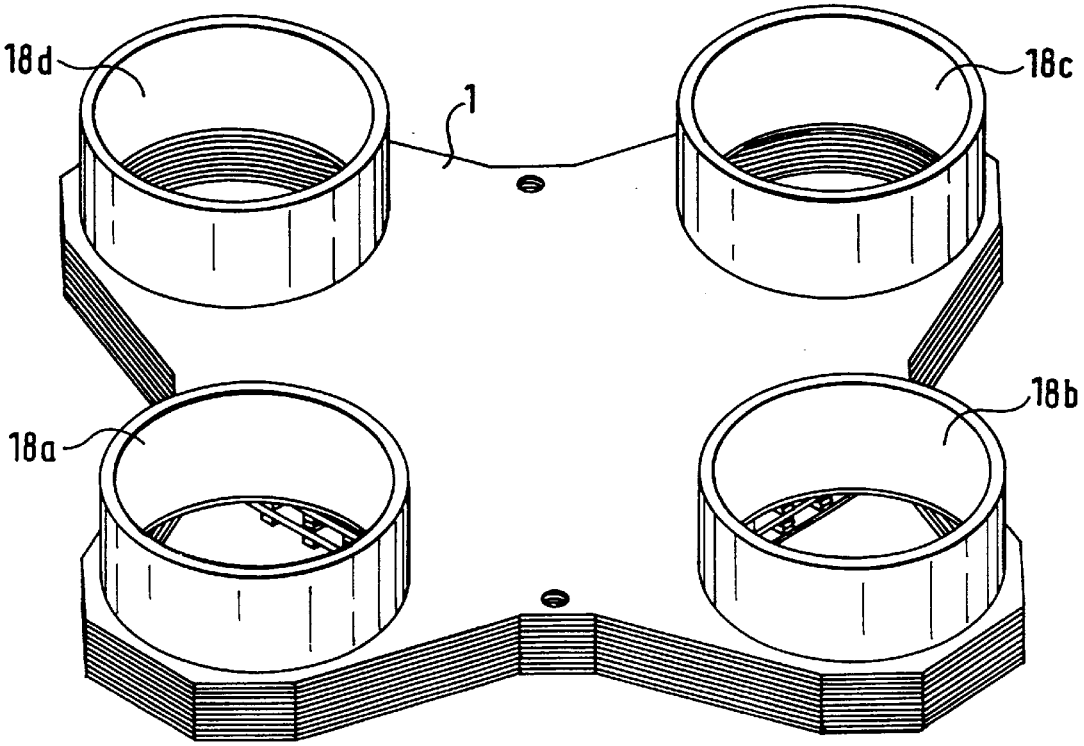
FIG. 6 is a perspective view of the heat transfer device with the plate stack of FIG. 1.

FIG. 6 is a perspective view of the finished heat transfer device plate stack 1. As illustrated particularly in conjunction with FIG. 1, in the case of this heat transfer device, the two fluids can be introduced by way of the connection openings 18*a* to 18*d* with a relatively large passage cross-section on a face of the plate stack 1 into the pertaining distributor duct and can be discharged from the pertaining collecting duct. In the case of a given dimension of the center area of the stack and a given plate number, the passage cross-section of the respective distributor duct and collecting duct can be optimally adjusted by the matching dimensioning of the exterior plate areas 10*a* to 10*d*, 14*a* to 14*d*; for example, at least as large as the effective total passage cross-section of all flow duct openings 6 in a fluidic connection therewith. As illustrated in conjunction with FIG. 1, the passage cross-section of the distributor ducts and collecting ducts is determined by the exterior portions of the connection duct openings defining the connection conduits 8*a* to 8*d* outside the area of the flow duct openings 6 and not, as in the case of the parent application, by their overlapping area with the flow duct openings 6. From the respective distributor connection conduit, the fluid arrives in the overlapping area and from there in the pertaining flow duct openings which it will then cross and leave again by way of the opposite overlapping area and the pertaining collecting connection conduit. As a result, while the stacked plate connection is still relatively compact, a heat transfer device is provided which has an optimized connection geometry for the flow duct openings 6 by means of which particularly low pressure loses can be achieved.

In the mouth areas of the flow duct openings 6, the comb web structures 12, 16 support the end areas of the separating webs 7 in that, together with these, they form a web structure which continues in the stacking direction. This provides the mouth areas between the exterior connection conduits 8*a* to 8*d* and the heat-transfer-active center area of the stack with a sufficient stability also in the active condition while the fluid flows through it.

It is understood that, in addition to the illustrated heat transfer device, other heat transfer devices according to the invention can also be implemented. For example, instead of the illustrated connection geometry, in which all four connection openings are situated on one side, a connection geometry may also he selected in the case of which two connection openings respectively are arranged on opposite plate stacking sides or three connection openings are arranged on one plate stack side and the fourth connection opening is arranged on the opposite plate stack side. In comparison to the illustrated embodiment, in this case only correspondingly modified connection plate units need to be used while the remaining plate stack construction may remain the same.

Preferred embodiments of the invention are used as high temperature cooling elements in electric vehicles.

In addition, the present heat transfer device naturally also has the characteristics and advantages mentioned in the parent application with respect to the embodiments described there.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Heat transfer device having a construction consisting of several plates which are stacked above one another and are provided with openings, comprising:

flow duct plate units with one or several side-by-side flow duct openings having equal-sided ends, which extend between two plate side areas, as well as with connection duct openings, which are arranged separately of the flow duct openings, and connection cover plate units which have connection duct openings which are arranged at least in two plate side areas, wherein the flow duct plate units and the connection cover plate units are alternately stacked on one another such that no fluidic connection exists between the flow duct openings of adjacent flow duct plate units; and such that the equal-sided ends of the flow duct openings of a respective flow duct plate unit are in a fluidic connection with one another by way of an overlapping connection duct opening of an adjacent connection cover plate unit, and are also in a fluidic connection with the equal-sided ends of the flow duct openings of, in each case, every alternate one of the flow duct plate units by way of overlapping connection duct openings of adjoining flow duct plate units, and wherein one connection duct opening respectively is provided on each plate side area of the flow duct plate units as well as of the connection cover plate units, such that respective mutually overlapping connection duct openings having exterior portions and equal sides form a connection conduit situated outside an area of the flow duct openings, from which connection conduit, with an exception of the connection duct openings which are arranged adjacent to the equal-sided ends of the flow duct openings in the respective flow duct plate units, the connection duct openings extend with one interior portion overlapping into an area of the equal-sided ends of the flow duct openings.

2. Heat transfer device according to claim 1, wherein a passage cross-section of the connection conduit forming a distributor duct or a collecting duct on a respective plate stack side by the mutually overlapping connection duct openings is at least approximately as large as a total passage cross-section of the flow duct openings which are in a fluidic connection with a corresponding distributor duct or collecting duct.

3. Heat transfer device according to claim 1, wherein the plate units have a rectangular center area which is adjoined along each of its four sides by one exterior area respectively which is curved to the outside, wherein the center areas of the flow duct plate units have a plurality of parallel flow duct openings which are laterally mutually spaced by separating webs, the flow duct openings of successive flow duct plate units extending perpendicularly with respect to one another, wherein the center areas of the connection cover plate units serve as cover areas for the respective adjoining flow duct openings, and wherein the exterior areas form closed hollow shapes which contain the connection duct openings, all exterior areas of each connection cover plate unit as well as the two exterior areas arranged transversely of the flow duct openings of each flow duct plate unit have a comb-type web structure along a side facing the center area such that equal-sided, comb-type web structures, together with equal-sided ends of the separating webs laterally separating the flow duct openings, form a web structure which continues through in the longitudinal direction of the stack and stabilizes a respective mouth area of the flow duct openings.

4. Heat transfer device according to claim 2, wherein the plate units have a rectangular center area which is adjoined along each of its four sides by one exterior area respectively which is curved to the outside, wherein the center areas of the flow duct plate units have a plurality of parallel flow duct openings which are laterally mutually spaced by separating webs, the flow duct openings of successive flow duct plate units extending perpendicularly with respect to one another, wherein the center areas of the connection cover plate units serve as cover areas for the respective adjoining flow duct openings, and wherein the exterior areas form closed hollow shapes which contain the connection duct openings, all exterior areas of each connection cover plate unit as well as the two exterior areas arranged transversely of the flow duct openings of each flow duct plate unit have a comb-type web structure along a side facing the center area such that equal-sided, comb-type web structures, together with equal-sided ends of the separating webs laterally separating the flow duct openings, form a web structure which continues through in the longitudinal direction of the stack and stabilizes a respective mouth area of the flow duct openings.

5. Heat transfer device according to claim 3, wherein an additional connection plate unit is provided which closes off the plate stack on one face and which has four connection openings, of which each is in a fluidic connection with a respective connection conduit, as well as by a cover plate without any fluid flow-through which closes off the plate stack on the opposite face.

6. Heat transfer device according to claim 4, wherein an additional connection plate unit is provided which closes off the plate stack on one face and which has four connection openings, of which each is in a fluidic connection with a respective connection conduit, as well as by a cover plate without any fluid flow-through which closes off the plate stack on the opposite face.

7. A method of making a heat transfer device comprising:

providing a plurality of flow duct plate units with at least one flow duct opening extending between the plate sides, providing connection cover plate units with connection duct openings in plate side areas, and alternately stacking the flow duct plate units and connection cover plate units with one another, wherein the connection duct openings are disposed outside an area of the flow duct openings, and wherein one connection duct opening respectively is provided on each plate side area of the flow duct plate units as well as of the connection cover plate units such that respective mutually overlapping connection duct openings having exterior portions and equal sides form a connection conduit situated outside an area of the flow duct openings, from which connection conduit, with an exception of the connection duct openings which are arranged adjacent to the equal-sided ends of the flow duct openings in the respective flow duct plate units, the connection duct openings extend with one interior portion overlapping into an area of the equal-sided ends of the flow duct openings.

* * * * *